US007760066B2

(12) United States Patent
Takeda

(10) Patent No.: US 7,760,066 B2
(45) Date of Patent: Jul. 20, 2010

(54) TEMPERATURE SWITCH

(75) Inventor: Hideaki Takeda, Misato (JP)

(73) Assignee: Uchiya Thermostat Co. Ltd. (JP)

( * ) Notice: Subject to any disclaimer, the term of this patent is extended or adjusted under 35 U.S.C. 154(b) by 232 days.

(21) Appl. No.: 11/990,881

(22) PCT Filed: Aug. 7, 2006

(86) PCT No.: PCT/JP2006/315578

§ 371 (c)(1),
(2), (4) Date: Feb. 22, 2008

(87) PCT Pub. No.: WO2007/043238

PCT Pub. Date: Apr. 19, 2007

(65) Prior Publication Data

US 2009/0102596 A1 Apr. 23, 2009

(30) Foreign Application Priority Data

Oct. 14, 2005 (JP) ..... 2005-299651

(51) Int. Cl.

| | |
|---|---|
| ***H01H 37/00*** | (2006.01) |
| ***H01H 61/04*** | (2006.01) |
| ***H01H 37/54*** | (2006.01) |
| ***H02H 5/04*** | (2006.01) |
| ***H01H 37/74*** | (2006.01) |

(52) U.S. Cl. ..... 337/391; 337/365; 337/340; 337/343; 337/85; 361/103; 361/105

(58) Field of Classification Search ..... 337/298, 337/365, 340, 391, 343, 85; 361/103, 105
See application file for complete search history.

(56) References Cited

U.S. PATENT DOCUMENTS

| | | | | |
|---|---|---|---|---|
| 2,533,671 | A * | 12/1950 | Jacobs, Jr. | 200/407 |
| 2,584,460 | A * | 2/1952 | Jacobs, Jr. | 200/407 |
| 3,146,378 | A * | 8/1964 | Grenier | 361/32 |
| 3,431,527 | A * | 3/1969 | Epstein | 337/347 |

(Continued)

FOREIGN PATENT DOCUMENTS

| | | |
|---|---|---|
| JP | 62-222529 | 9/1987 |

(Continued)

OTHER PUBLICATIONS

PCT Application No. PCT/JP2006/315578, International Search Report mailed Oct. 17, 2006, 1 pg.

*Primary Examiner*—Jayprakash N Gandhi
*Assistant Examiner*—Bradley H Thomas
(74) *Attorney, Agent, or Firm*—Schwegman, Lundberg & Woessner, P.A.

(57) ABSTRACT

In a temperature switch, a cut-out portion of the substrate is formed of a first cut-out portion and a second cut-out portion which are made from the side part toward the center. At a fixation part of a movable plate in the temperature switch, a pawl part and an elastic locking part having an L-shaped cross section are formed adjacent to the pawl part on the upstream side in the sliding direction. When the pawl part is fitted in the second cut-out portion, a tip of the elastic locking part abuts an end portion-top surface of the substrate and the elastic locking part reversibly warps upwardly.

11 Claims, 7 Drawing Sheets

U.S. PATENT DOCUMENTS

| | | | | | |
|---|---|---|---|---|---|
| 3,936,788 | A | * | 2/1976 | Uchiya | 337/372 |
| 4,278,960 | A | * | 7/1981 | Muller et al. | 337/365 |
| 4,306,211 | A | * | 12/1981 | Hofsass | 337/89 |
| 4,316,168 | A | * | 2/1982 | Nakaho et al. | 337/359 |
| 4,317,097 | A | * | 2/1982 | Hofsass | 337/89 |
| 4,445,107 | A | * | 4/1984 | Hollweck | 337/343 |
| 4,507,642 | A | * | 3/1985 | Blackburn | 337/89 |
| 4,847,587 | A | | 7/1989 | Muller | |
| 4,862,133 | A | * | 8/1989 | Tabei | 337/102 |
| 5,014,034 | A | * | 5/1991 | Wehl | 337/368 |
| 5,014,035 | A | * | 5/1991 | Hamada et al. | 337/372 |
| 5,182,538 | A | * | 1/1993 | Muller | 337/102 |
| 5,268,664 | A | * | 12/1993 | Givler | 337/380 |
| 5,309,131 | A | * | 5/1994 | Hofsass et al. | 337/102 |
| 5,367,279 | A | * | 11/1994 | Sakai | 337/104 |
| 5,607,610 | A | * | 3/1997 | Furukawa | 219/505 |
| 5,847,637 | A | * | 12/1998 | Takeda et al. | 337/344 |
| 5,870,014 | A | * | 2/1999 | Nield et al. | 337/362 |
| 5,939,970 | A | * | 8/1999 | Tsuji et al. | 337/343 |
| 6,300,860 | B1 | * | 10/2001 | Hofsass | 337/377 |
| 6,396,381 | B1 | * | 5/2002 | Takeda | 337/377 |
| 6,498,559 | B1 | * | 12/2002 | Cornell et al. | 337/53 |
| 6,559,752 | B1 | * | 5/2003 | Sienkiewicz et al. | 337/53 |
| 6,577,223 | B2 | * | 6/2003 | Takeda | 337/377 |
| 6,597,273 | B2 | * | 7/2003 | Takeda | 337/327 |
| 6,756,876 | B2 | * | 6/2004 | Sullivan et al. | 337/111 |
| 7,026,907 | B2 | * | 4/2006 | Takeda | 337/85 |

FOREIGN PATENT DOCUMENTS

| | | |
|---|---|---|
| JP | 1-166943 | 6/1989 |
| WO | WO-87/03137 A2 | 5/1987 |

* cited by examiner

TEMPERATURE SWITCH

RELATED APPLICATION

This application is a nationalization under 35 U.S.C. 371 of PCT/JP2006/315578, filed Aug. 7, 2006 and published as WO 2007/043238 A1 on Apr. 19, 2007, which claimed priority under U.S.C. 119 to Japanese Application No. 2005-299651, filed Oct. 14, 2005, which applications and publication are incorporated herein by reference and made a part hereof.

TECHNICAL FIELD

The present invention relates to a temperature switch, and particularly to a temperature switch that is mounted directly on a substrate made of, for example, ceramic or the like.

BACKGROUND ART

Traditionally, bimetal temperature switches configured using a ceramic substrate as an insulative support for a thermostat have been proposed. (See, for example, International Patent Application Publication No. WO87/03137) FIGS. 1A, 1B, and 1C show an example of a conventional bimetal temperature switch that uses a ceramic substrate as an insulative support for a thermostat.

As shown in FIGS. 1A, 1B, and 1C, this bimetal temperature switch comprises a thin and rectangular support 1 made of alumina-ceramic. At the center of the support 1, a groove 2 is formed, and longitudinal ends of a bottom surface 1*a* are metalized.

Terminal tabs 3 and 4 are respectively fixed to these metalized longitudinal ends of the support 1.

Each of these terminal tabs 3 and 4 has a hole for soldering on one end, and the other end is divided three portions so as to form a fork shape The end comprises a pair of protrusions 6 on the outer sides, respectively, and a protrusion 7 at the center in such a manner that the pair of protrusions 6 and protrusion 7 great different vertical levels.

The pair of protrusions 6 at the lower level are jointed to the metalized ends on the bottom surface 1*a* of the support 1. The protrusion 7 that is at the higher level contacts the upper surface of the support 1.

A contact spring 8 has a hole 11 approximately at its center, and a pin 12 made of plastic is inserted into this hole 11. A head 13 of the pin 12 is engaged with the top plane of the contact spring 8, and a lower pole runs through a hole 14 at the center of a bimetal plate 15 and the groove 2 on the support 1.

The bimetal plate 15 is disposed between the support 1 and the spring 8. A collar 16 of the pin 12 is disposed between the contact spring 8 and the bimetal plate 15 in order to serve as a spacer and to provide thermal insulation between the contact spring 8 and the bimetal plate 15.

Also, a film resistor 17 is disposed on the bottom surface 1*a* of the support 1. This film resistor 17 is electrically connected to the terminal tabs 3 and 4 via conductive strips 18.

When the bimetal plate 15 is inverted in response to a temperature equal to or greater than the switching temperature and lifts the contact spring 8, electric currents flow only through the film resistor 17, while the support 1 is heated and itself heats the bimetal plate 15; thereby the spring prevents the bimetal plate 15 from returning to the original position that closes the switch.

As described above, because the collar 16 of the pin 12 serves as a spacer and provides thermal insulation between the contact spring 8 and the bimetal plate 15, the bimetal plate 15 is hardly affected at all by the Joule heat generated in the contact spring 8.

Additionally, the invention disclosed in the above International Patent Application Publication No. WO87/03137 is based on a concept that a heat source for operating the bimetal temperature switch (referred to as a temperature switch hereinafter) is externally provided (in other words, the temperature switch is operated as a single unit), and this invention employs a configuration for detecting external hot air.

The above conventional temperature switch contains six problems.

The first problem is that the temperature switch employs a configuration to set a special function so that once the status of the switch changes, the switch does not return to the original state when this switch is connected to an external circuit in series. In other words, this switch does not have a common function for opening and closing in accordance with temperature variations.

The second problem is that this temperature switch does not perform heat detection efficiently because this switch has a low responsiveness to heat, and thus reliability is a problem when this switch is used for controlling the temperature of a hot plate heater that is included in, for example, a hair iron or is used for protecting the hot plate heater.

The third problem is that this switch consists of a large number of parts, and for engaging these parts or mounting these parts on the substrate, operations such as welding, soldering, brazing, caulking, rivet caulking, catching, and the like are often required. Thus, the configurations are complicated, and many steps have to be executed for the assembly.

The fourth problem is that performing caulking requires a highly developed skill because substrates are sometimes broken when performing caulking if the substrates are made of ceramic, leading to a lower yield. However, it is difficult to acquire personnel having such a highly developed skill.

The fifth problem is that the engagement based on catching requires a step of bending an elastic material, and it is impossible to bend an elastic material at a sufficient level so as to cause the catching functions because assembly of the elastic material causes a spring back that is too strong.

The sixth problem is that to form a catching part by bending an elastic material before assembly while also taking the margin of the spring back into consideration requires a step of sliding the catching part of the temperature switch from an end portion to the engagement part in the substrate. This greatly limits the shaping of the substrates and the positioning of engagement parts, thereby decreasing degrees of freedom.

In view of the above problems, it is an object of the present invention to provide a temperature switch that consists of a minimum number of components, that is inexpensive, that is highly responsive to heat detection when being used for a hot plate heater, and that can easily be attached to a substrate made of ceramic or the like.

DISCLOSURE OF THE INVENTION

A temperature switch according to the present invention is a temperature switch having an insulation substrate to which a fixed contact connected to one external terminal is attached, a movable plate that is attached to the insulation substrate, a movable contact at a position facing the fixed contact and that is connected to the other external terminal, and a thermally actuated element that is loosely attached to the movable plate and whose warping direction is inverted at a prescribed temperature for electrically opening and closing a line between one said external terminal and the other said external terminal connected to the fixed contact and the movable contact, wherein:

the movable plate has, on both sides thereof, pawl parts each having a U-shaped cross section with an opening height that catches a side portion thickness of the insulation substrate;

the insulation substrate has, on both sides thereof, cut-out portions that are wider than widths of the pawl parts and deeper than tip lengths of the pawl parts; and the movable plate catches both side-portions of the insulation plate and is fixed to the insulation substrate by using the pawl parts when the pawl parts are fitted into the cut-out portions and are able to slide in a prescribed pawl width direction.

In one example of the above temperature switch:

the cut-out portion has two steps in a direction from a side portion to a center of the insulation substrate;

the pawl part has a width that is smaller than the width of a second cut-out portion of the insulation substrate having the two steps, has a tip length that is smaller than the depth of the second cut-out portion, and has an opening height that catches a side-portion thickness having a first cut-out portion of the insulation substrate having the two steps; and the movable plate is positioned with the width-direction-end part at a sliding-direction-downstream side of the pawl part abutting a gap portion between the first cut-out portion and the side portion, and the pawl part catches a side-portion thickness having the first cut-out portion of the insulation substrate and is fixed to the insulation substrate when the pawl part is fit into the second cut-out portion, and the movable part slides in a direction of the first cut-out portion direction.

In another example of the above temperature switch:

the movable plate has an elastic locking part that is adjacent to the pawl part on a sliding-direction-upstream side, has an L-shaped cross section, and has a projection length smaller than that of the pawl part; and the entirety of the elastic locking part reversibly warps upward with the L-shaped tip abutting a top surface of the insulation substrate when the pawl part is fitted into the second cut-out portion, and recovers from warping and is positioned with the L-shaped tip overlapping the second cut-out portion and with the width-direction-end part on a sliding-direction-downstream side abutting a gap portion between the first cut-out portion and the second cut-out portion.

In the above case, as one example, it is desirable to employ a configuration in which:

a substrate-thickness having the first cut-out portion of the insulation substrate is formed to be one step smaller than a thickness of substrate main body; and an opening height of the pawl part of the movable plate is formed to be one step narrower than a thickness of the substrate main body, and is formed to be large enough to catch a substrate thickness having the first cut-out portion. Further, as another example, it is also possible to employ a configuration in which:

the main body of the insulation substrate comprises two insulation substrates consisting of an upper insulation substrate and a lower substrate; and the first cut-out portion is formed on the upper insulation substrate of the main body.

In the above case, as an example, it is desirable to employ a configuration in which:

in the movable plate, when the pawl parts slide and are engaged with the first cut-out portion of the insulation substrate and an entirety is fixed to the insulation substrate, the pawl parts are set to be further in than the same plane on both side surfaces and a bottom surface of the insulation substrate, respectively.

In the above temperature switch, it is also possible to configure the insulation substrate by using a ceramic substrate including a heater.

BEST MODES FOR CARRYING OUT THE INVENTION

First Embodiment

Figure 1A:
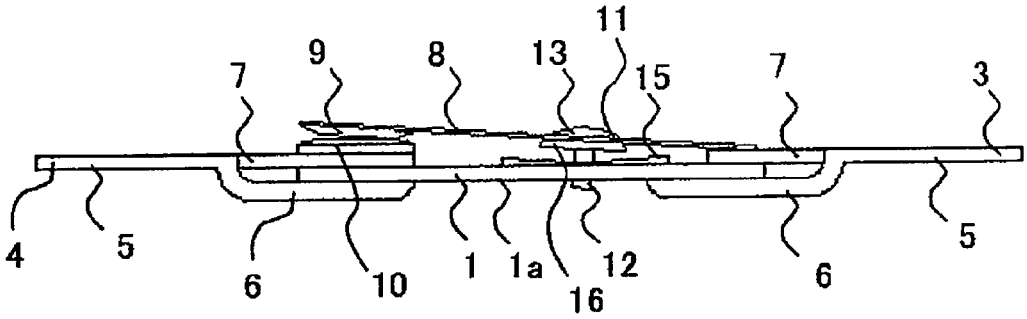
FIG. 1A (PRIOR ART)
FIG. 1A shows an example of a conventional bimetal temperature switch that uses a ceramic substrate as an insulation support for a thermostat.
Figure 1B:
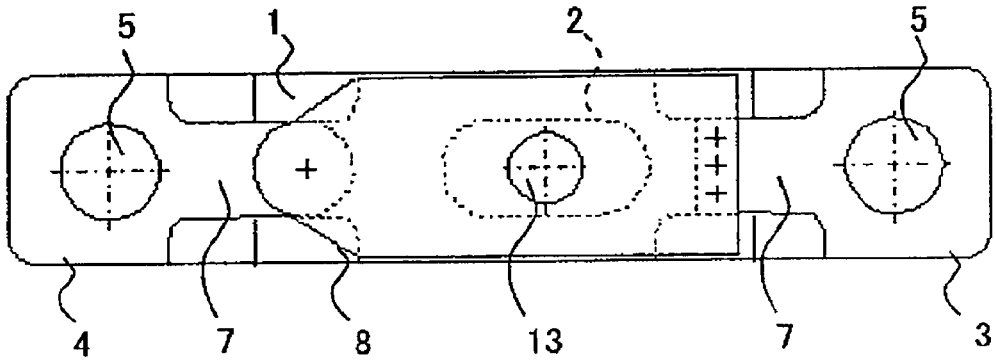
FIG. 1B (PRIOR ART)
FIG. 1B also shows an example of a conventional bimetal temperature switch that uses a ceramic substrate as an insulation support for a thermostat.
Figure 1C:
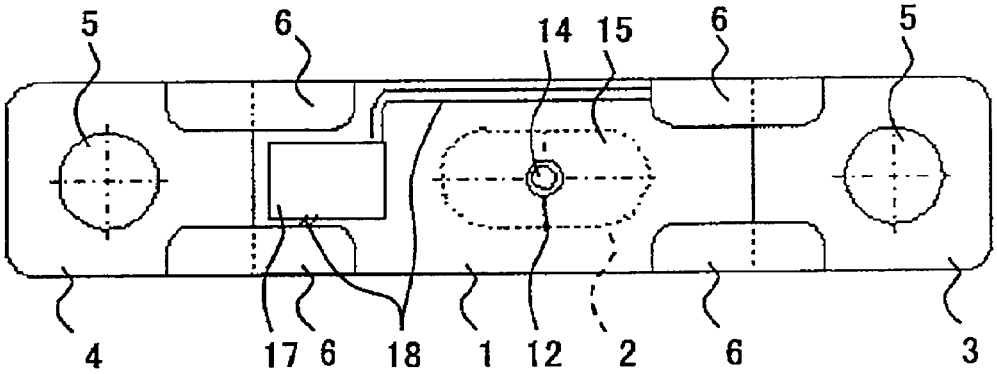
FIG. 1C (PRIOR ART)
FIG. 1C also shows an example of a conventional bimetal temperature switch that uses a ceramic substrate as an insulation support for a thermostat.
Figure 2A:
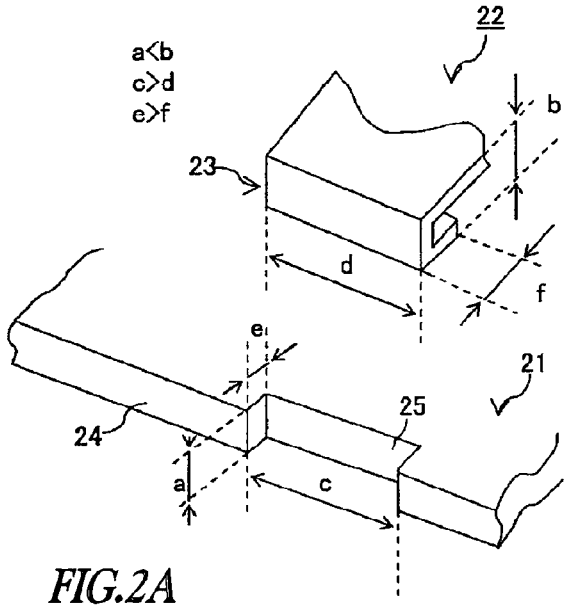
FIG. 2A shows a configuration of an engagement part of a movable plate and an engagement part of an insulation substrate.
Figure 2B:
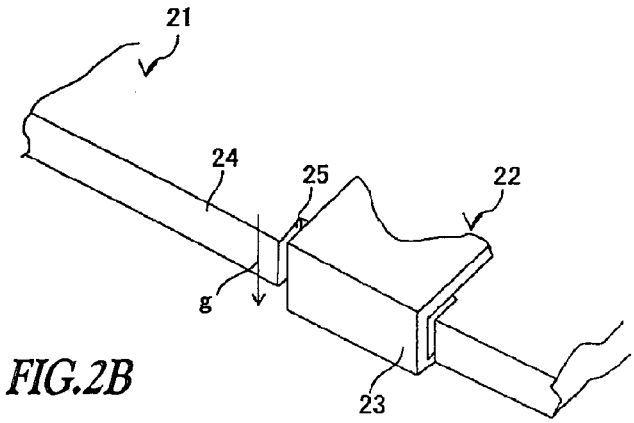
FIG. 2B shows an operating state of the above parts being engaged with each other.
Figure 2C:
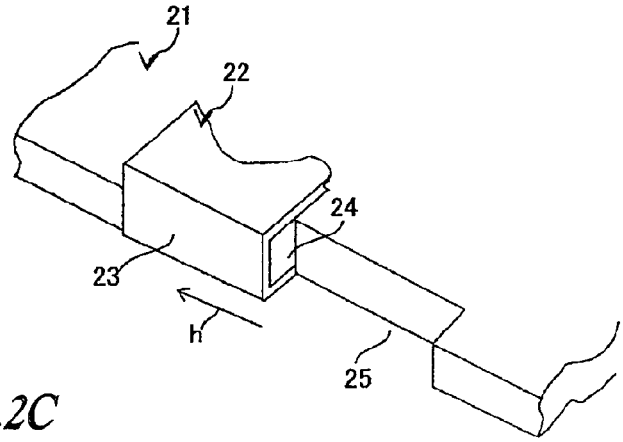
FIG. 2C also shows the operating state of the above parts being engaged with each other.

FIG. 2A shows a configuration of an engagement part of a movable plate and a configuration of an engagement part of an insulative substrate. FIGS. 2B and 2C show the operating states of the parts being engaged with each other.

An insulative substrate (hereinafter, simply referred to as substrate) 21 shown in FIG. 2A is, for example, a rectangular substrate made of ceramic. This substrate comprises a fixed contact and two external terminals, which will later be explained in detail. The fixed contact is connected to one of the external terminals.

FIG. 2A shows only a shape of the substrate 21 around its engagement part at one of the side portions.

Also, a movable plate 22 shown in FIG. 2A comprises a movable part and a fixation part in an integrated manner by performing stamping, embossing, and bending on the elastic plate member. The movable part comprises a movable contact disposed at a position that faces the above fixed contact. The fixation part comprises a connection part that is connected to the other external terminal of the two external terminals above.

Also, FIG. 2A shows only a shape of the movable plate 22 around the engagement part at one of the side portions of the fixation part.

Also, this movable plate 22 comprises a bimetal that is in the shape of a shallow bowl as a thermally actuated element that is disposed between the above movable and fixation parts and is loosely attached to the movable plate 22.

The bimetal has a heat characteristic in which the direction in which it warps is inverted at a prescribed temperature, and the movable part of the movable plate 22 is caused to move with respect to the substrate 21 in response to the inverting operation of the bimetal; thereby the above fixed contact and the movable contact separate from and come in contact with each other.

Thereby, the movable plate 22 constitutes a temperature switch that electrically opens and closes a circuit between one external terminal connected to the above fixed contact and the other external terminal connected to the above fixation part.

The above movable plate 22, as shown in FIG. 2A, comprises pawl parts 23 at both ends. Each pawl part 23 has an opening with the height of "b" that catches the thickness "a" of a side portion 25, and has a cross section in a U shape.

The substrate 21 comprises cut-out portions 24 at both sides. Each cut-out portion 24 is formed to have a width "c" that is greater than the width "d" of the pawl part 23 of the movable plate 22, and has a depth "e" that is greater than the tip length "f" of the pawl part 23.

The relationships among the above side portion's thickness "a" of the substrate 21, the opening height "b" of the pawl part 23 of the movable plate 22, the width "c" of the cut-out portion 24 of the substrate 21, the width "d" of the pawl part 23 of the movable plate 22, the depth "e" of the cut-out portion 24 of the substrate 21, and the tip length "f" of the pawl part 23 of the movable plate 22 can be expressed as "a"<"b", "c">"d", and "e">"f".

When the above movable plate 22 is attached to the substrate 21, first, the pawl part 23 is fitted into the cut-out portion 24 of the substrate 21 as indicated by the arrow "g" in FIG. 2B. Next, as shown in FIG. 2C, the movable plate 22, i.e., the pawl part 23 slides in the prescribed pawl-part-width direction as indicated by the arrow "h".

Thereby, both of the cut-out portions 24 (only one of the two is shown) of the substrate 21 are caught by the pawl part 23 (of the fixation part) of the movable plate 22, and the movable plate 22 is fixed to the substrate 21.

Second Embodiment

Figure 3A:
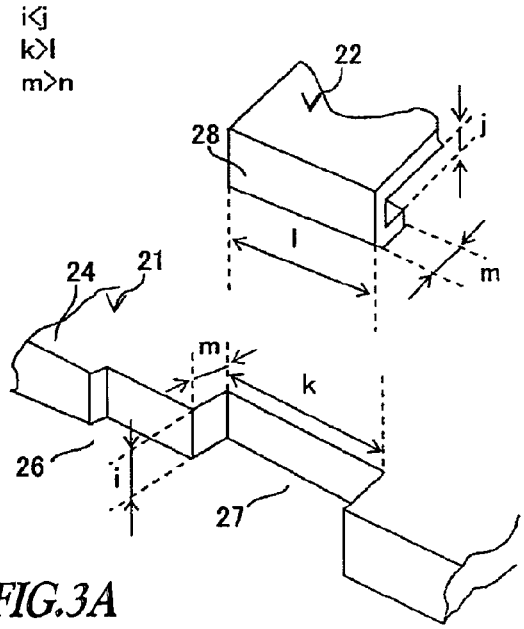
FIG. 3A shows a configuration of an engagement part of a movable plate and an engagement part of a substrate according to a second embodiment.
Figure 3B:
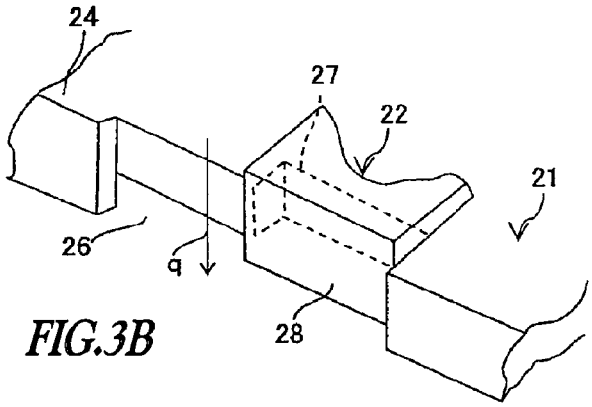
FIG. 3B shows an operating state of the above parts being engaged with each other.
Figure 3C:
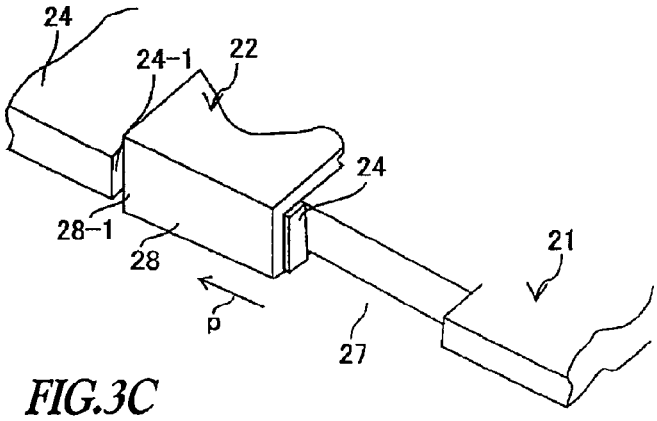
FIG. 3C also shows the operating state of the above parts being engaged with each other.

FIG. 3A shows a configuration of an engagement part of a movable plate and an engagement part of a substrate according to a second embodiment. FIGS. 3B and 3C show operating states of the parts being engaged with each other.

As shown in FIG. 3A, the cut-out portion formed on a side portion 24 of the substrate 21 according to the present embodiment comprises, counting in the direction from the side portion to the center of the substrate 21, two cut-out portions, i.e., a first cut-out portion 26 and a second cut-out portion 27.

As shown in FIG. 3A, a pawl part 28 of the movable plate 22 is formed to have a U-shaped cross section similar to that in FIG. 2A. However, in the present embodiment, the pawl part 28 has a width "l" that is smaller than the width "k" of the second cut-out portion 27 of the substrate 21, a tip length "n" that is smaller than the depth "m" of the second cut-out portion 27, and an opening height "j" that catches the thickness "i" of the side portion 24 including the first cut-out portion 26 of the substrate 21.

The relationships among the above thickness "i" of the side portion 24 of the substrate 21, the opening height "j" of the pawl part 28 of the movable plate 22, the width "k" of the second cut-out portion 27 of the substrate 21, the width "l" of the pawl part 28, of the movable plate 22, the depth "m" of the second cut-out portion 27 of the substrate 21, and the tip length "n" of the pawl part 28 of the movable plate 22 can be expressed as "i"<"j", "k">"l", and "m">"n".

When the above movable plate 22 is attached to the substrate 21, first, the pawl part 28 of the movable plate 22 is fitted into the second cut-out portion 27 of the substrate 21 as indicated by the arrow "q" in FIG. 3B. Next, as shown in FIG. 3C, the pawl part 28 of the movable plate 22 slides in the direction of the first cut-out portion 26 as indicated by the arrow "p".

Thereby, a width-direction end 28-1 in the downstream sliding direction of the pawl part 28 is positioned by abutting a gap portion 24-1 between the first cut-out portion 26 and the side portion 24. Also, the pawl part 28 catches the side portion 24 including the first cut-out portion 26 of the substrate 21, and the movable plate 22 is fixed to the substrate 21.

As described above, according to the second embodiment of the present invention, because the substrate 21 includes the first cut-out portion 26 and the second cut-out portion 27, when the pawl part 28 of the movable plate 22 is inserted into the second cut-out portion 27 and the plate slides in the direction of the first cut-out portion 26, it is easy to position the plate by sliding the tip of the pawl part 28 to the end surface of the first cut-out portion.

Third Embodiment

Figure 4A:
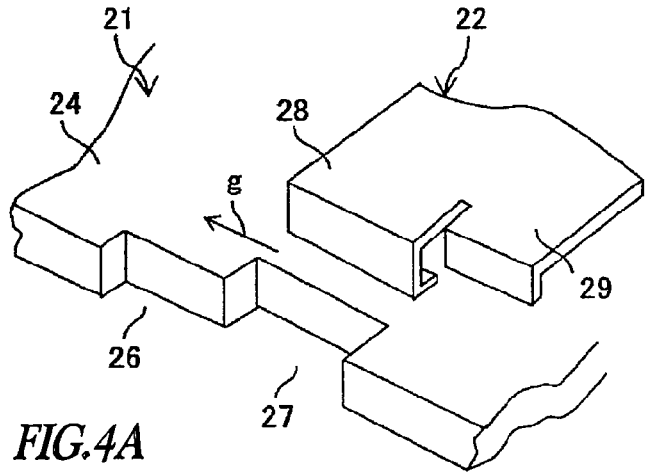
FIG. 4A shows a configuration of an engagement part of a movable plate and an engagement part of a substrate according to a third embodiment.
Figure 4B:
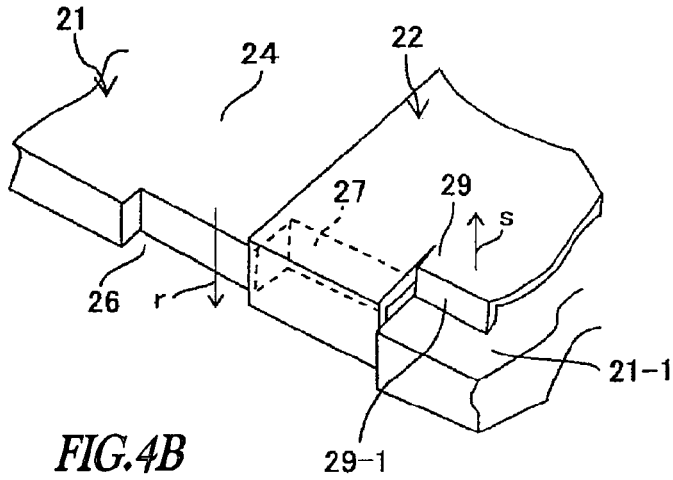
FIG. 4B shows an operating state of the above parts being engaged with each other.
Figure 4C:
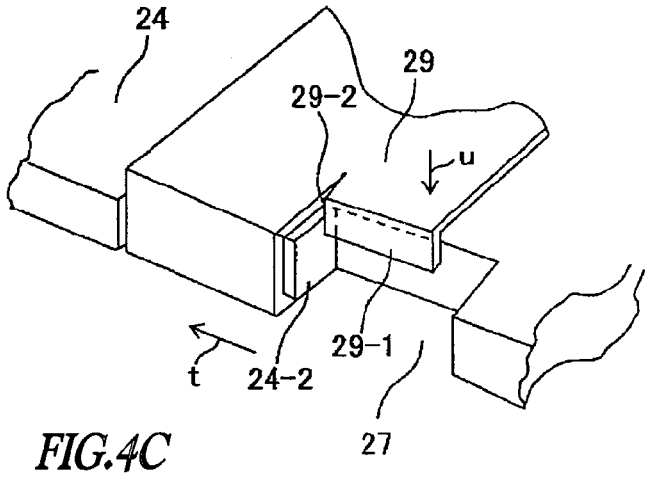
FIG. 4C also shows the operating state of the above parts being engaged with each other.

FIG. 4A shows a configuration of an engagement part of a movable plate and an engagement part of a substrate according to a third embodiment. FIGS. 4B and 4C show operating states of the parts being engaged with each other.

As shown in FIG. 4A, the cut-out portion formed on the substrate 21 according to the present embodiment comprises, counting in the direction from the side portion to the center of the substrate 21, the first cut-out portion 26 and the second cut-out portion 27, completely the same to the configuration shown in FIG. 3.

The movable plate 22 comprises an elastic locking part 29 that is adjacent to the pawl part 28 at the sliding-direction-upstream side as indicated by the arrow "g" and that has an L-shaped cross section having a projection length that is smaller than that of the pawl part 28. Additionally, the dimensions of the above second cut-out portion 27 and the pawl part 28 are the same as those in the case of FIG. 3A.)

As indicated by the arrow "r" in FIG. 4B, when the pawl part 28 is fitted into the second cut-out portion 27, a tip 29-1 in the L shape abuts the end-portion-top surface 29-1 of the substrate and the above elastic locking part 29 reversibly warps upward as indicated by the arrow "s".

Then, when the pawl part 28 slides in the direction of the first cut-out portion 26 as indicated by the arrow t in FIG. 4C, and the movable plate 22 is fixed to the substrate 21, the elastic locking part 29 recovers to the original state from the warping state, and the L-shaped tip part 29-1 overlaps the second cut-out portion 27 as indicated by the arrow "u".

Further, a width-direction-end portion 29-2 in the downstream sliding direction of the elastic locking part 29 abuts a gap portion 24-2 between the first cut-out portion 26 and the second cut-out portion 27, and the movable plate 22 is positioned on the substrate 22.

As described above, according to the third embodiment of the present invention, an L-shaped locking elastic part that is bent at a right angle in, for example, a downward direction is provided to a downstream portion in the sliding direction of the pawl part 28 of the movable plate 22. Accordingly, when the pawl part 28 is inserted into the second cut-out portion 27 and slides in the direction of the first cut-out portion 26, the elastic locking part 29 drops to overlap the second cut-out portion 27 before the tip of the pawl part 28 abuts the end surface of the first cut-out portion.

As described above, because the elastic locking part 29 drops to overlap the second cut-out portion 27, once the pawl part 28 slides in the direction of the first cut-out portion 26, the pawl part 28 catches the end part 24 at the first cut-out portion 26, and is prevented from sliding back.

In other words, the movable plate 22 that is once fixed to the substrate 21 gets in a fixed state with respect to the substrate 21.

Also, it is possible to configure the engagement portion in the present embodiment in such a manner that the outer-end surface having the width "l" of the pawl part 28 of the movable plate 22 does not extend beyond the end surface of the side portion 24 of the substrate 21.

By employing the above configuration, it is possible to avoid the trouble that occurs when the substrate 21 including the movable plate 22 (i.e., the substrate 21 including a temperature switch) is provided to an external device, whereupon an insulation material cannot be set to a space between the side-end surface of the substrate 21 and the external device due to the projection of the pawl part 28 of the movable plate 22.

Fourth Embodiment

Figure 5A:
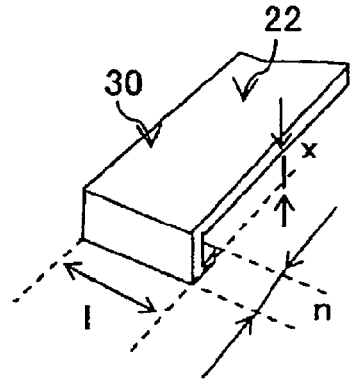
FIG. 5A shows a pawl part according to a fourth embodiment.
Figure 5B:
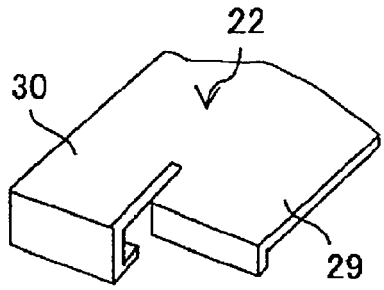
FIG. 5B shows a state in which a locking part is formed adjacent to the pawl part.
Figure 5C:
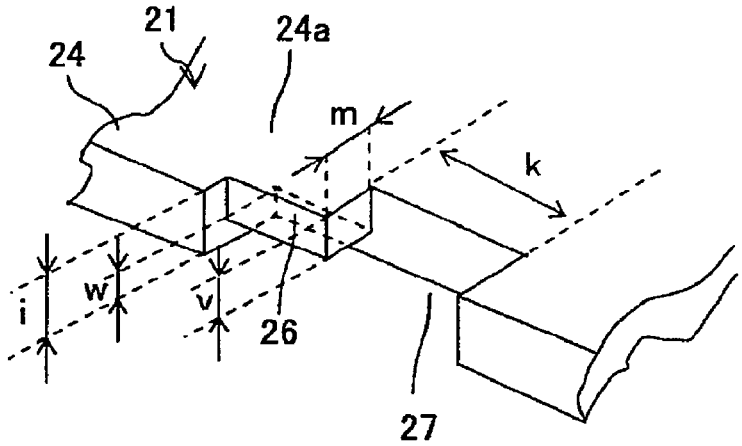
FIG. 5C shows a shape of a cut-out portion of the substrate that is engaged with the pawl part.

FIG. 5A shows a pawl part having opening heights that are different from each other according to the fourth embodiment. FIG. 5B shows a state in which a locking part is formed adjacent to the pawl part. FIG. 5C shows the shape of the cut-out portion of the substrate that is engaged with the pawl part.

The substrate 21 according to the fourth embodiment shown in FIG. 5C includes two cut-out portions that are similar to the configuration shown in FIG. 4A. The thickness "v" of a substrate side portion 24*a* that has the first cut-out portion 26 is smaller than the thickness "i" of the above described substrate main body 24 by the gap width "w".

Also, the opening height "x" of the pawl part 30 of the movable plate 22 according to the present embodiment shown in FIG. 5A is one step smaller than the thickness "i" of the substrate main body, and is large enough to catch the thickness "v" of the substrate side portion 24*a* having the first cut-out portion 26.

Additionally, the relationship between the dimensions of the pawl part 30 of the movable plate 22, except for the opening height "x", and the dimensions of the second cut-out portions 27 is the same as the relationship between the pawl part 28 of the movable plate 22 and the second cut-out portion 27 of the substrate 21 shown in FIGS. 2 through 4.

In other words, in FIGS. 5A and 5C, the relationship between the width "l" of the pawl part 30 and the width "k" of the second cut-out portion 27 is expressed as "l<k". The relationship between the tip length "n" of the pawl part 30 and the depth "m" of the second cut-out portion 27 is expressed as "n<m".

Additionally, in the above example, the simple configuration of the pawl part 30 shown in FIG. 5A is used for facilitating the explanation of the relationship of the dimensions between the pawl part 30 and the configuration having the two cut-out portions.

The configuration of the pawl part 30 shown in FIG. 5A can also be employed, of course. However, it is desirable to employ the configuration of the pawl part 30 that comprises the L-shaped locking part 29 shown in FIG. 5B on the downstream side of the sliding direction.

In the configuration of the engagement portion according to the fourth embodiment, it is possible to not only prevent the outer-end surface having the width "l" of the pawl part 30 of the movable plate 22 from extending beyond the end surface of the side portion 24 of the substrate 21, but also from extending beyond the bottom surface of the substrate 21.

By employing the above configuration, it is possible to avoid the trouble that occurs when the substrate 21 comprising a temperature switch together the movable plate 22, is provided to an external device, whereupon an insulation material cannot be set to a space between the side-end surface of the substrate 21 and the external device or between the bottom surface of the substrate 21 and the external device due to the projection of the pawl part 28 of the movable plate 22.

Fifth Embodiment

Figure 6:
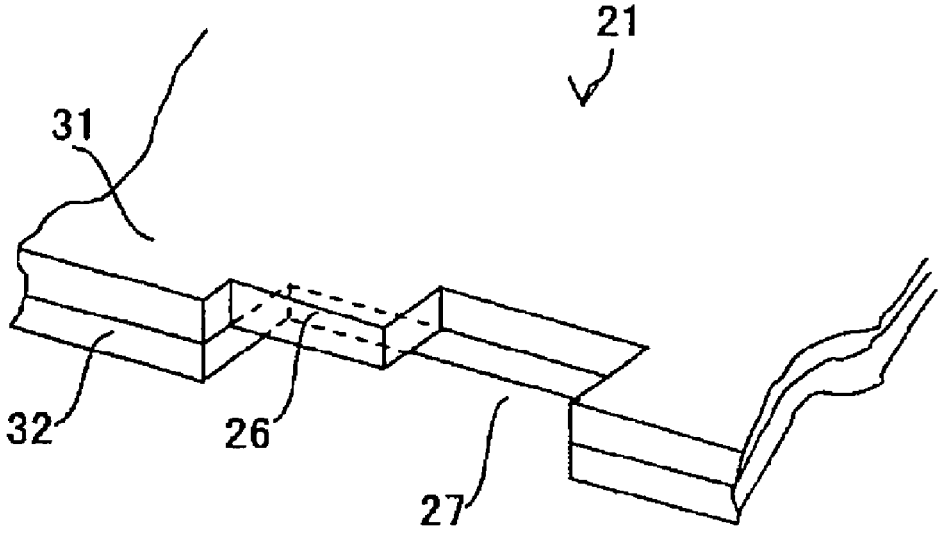
FIG. 6 shows a configuration of a cut-out portion of the substrate according to a fifth embodiment.

FIG. 6 shows a configuration of a cut-out portion of the substrate according to a fifth embodiment. As shown in FIG. 6, the cut-out portion according to the present embodiment comprises, similarly to the cut-out portion shown in FIG. 5C, the first cut-out portion 26 and the second cut-out portion 27.

However, the main body of the substrate 21 according to the present embodiment comprises two substrates, i.e., an upper substrate 31 and a lower substrate 32, and the first cut-out portion 26 is formed on the upper substrate 31, which is a different point from that in the configuration shown in FIG. 6.

The substrate 21 according to the present embodiment is the same as that shown in FIG. 5C in its dimensions, shapes, and the like except for the fact that the main body of the substrate 21 according to the present embodiment comprises the upper and the lower substrates 31 and 32.

In this case, similar to the fourth embodiment, it is possible to prevent the outer-end surface having the width "l" of the pawl part 30 of the movable plate 22 not only from extending beyond the end surface of the side portion 24 of the substrate 21, but also from extending beyond the bottom surface of the substrate 21.

By employing the above configuration, it is possible to avoid the trouble that occurs when the substrate 21 comprising a temperature switch together the movable plate 22, is provided to an external device, whereupon the thermal contact and thermal insulation is disturbed when, for example, the substrate 21 is made of two ceramic substrates including a heater, because there is not a projection of the pawl part 28 of the movable plate 22 on the side-end surface of the bottom surface of the substrate 21.

Sixth Embodiment

Figure 7C:
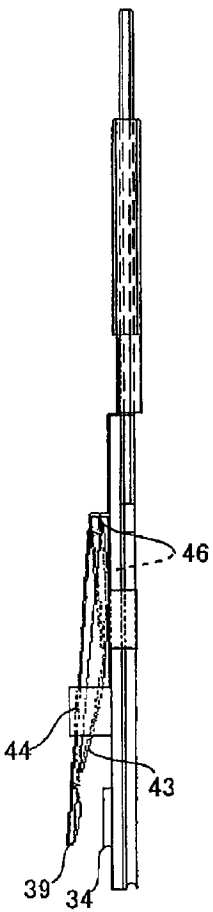
FIG. 7C is another lateral view for showing the operating state of the temperature switch.
Figure 7B:
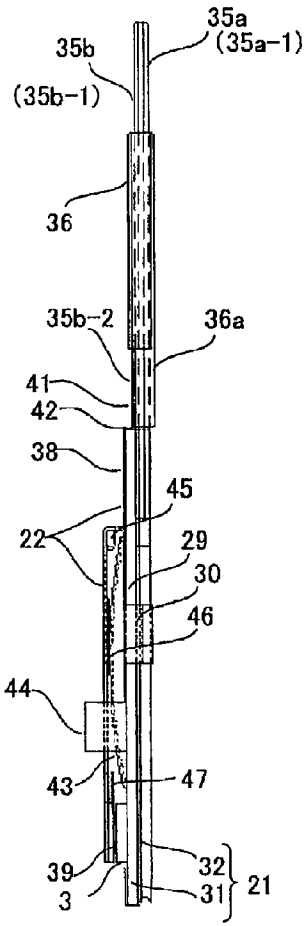
FIG. 7B is a lateral view for showing an operating state of the temperature switch.
Figure 7A:
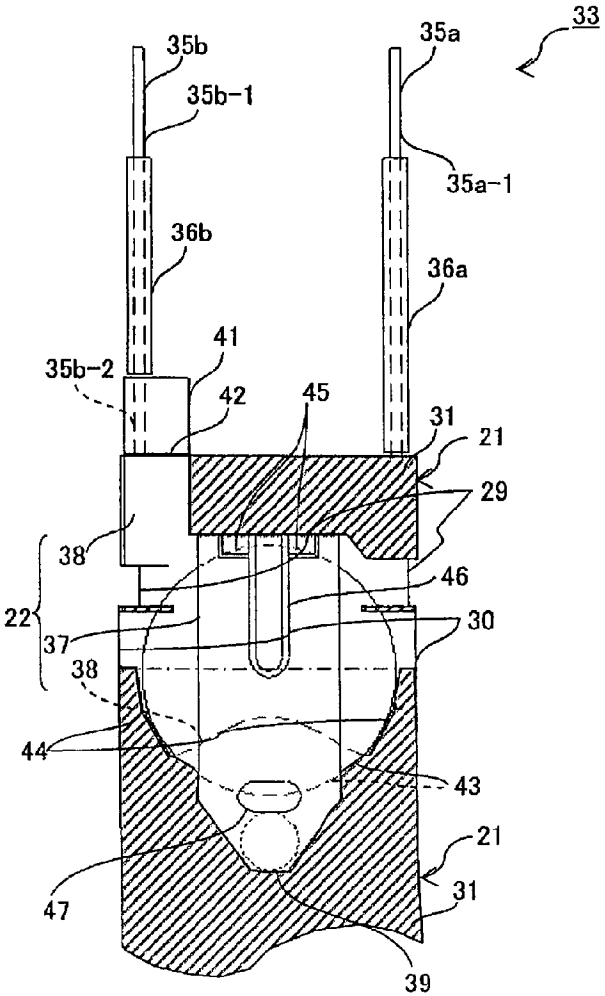
FIG. 7A shows an example of a temperature switch according to a sixth embodiment.

FIG. 7A shows an example of a temperature switch 33 according to a sixth embodiment. FIGS. 7B and 7C are lateral views showing the operating states of the temperature switch 33.

FIGS. 7A and 7B show the substrate 21 having the configuration shown in FIG. 6, i.e., the substrate whose main body comprises the upper and lower substrates 31 and 32, and the engagement portion for the movable plate 22 comprising the first cut-out portion 26 and the second cut-out portion 27.

Also, FIGS. 7A and 7B show the movable plate 22 in the configuration shown in FIG. 6, i.e., the movable plate 22 having the pawl part 30 that catches the first cut-out portion 26 of the substrate 21 and the elastic locking part 29 formed adjacent to the pawl part 30.

In FIGS. 7A, 7B, and 7C, the substrate 21 (the upper and the lower substrates 31 and 32) is, for example, a rectangular substrate made of ceramic, and the upper substrate 31 has a fixed contact 34.

Also, one end of the substrate 21 in the longitudinal direction (the lower half of the rectangle is omitted in FIG. 7A) has two external terminals 35*a* and 35*b*. The external terminal 35*a* and the above fixed terminal 34 are connected to each other via a line (not shown).

The external terminal 35*a* is covered to its base by an insulation member 36*a* except for a connection part 35*a*-1 that is connected to one terminal of one external device. The external terminal 35*b* is covered to its base by an insulation member 36*b* except for a connection part 35*b*-1 connected to the other terminal of the external device and except for a base-vicinity-portion 35*b*-2.

The movable plate 22 comprises a movable part 37 and a fixation part 38 in an integrated manner by performing stamping, embossing, and bending on an elastic plate member. The movable part 37 comprises a movable contact 39 disposed at a position that faces the above fixed terminal 34. The fixation part 38 comprises a connection part 41 that is connected, in a pressure contacting manner, to the other external terminal of the above two external terminals on the substrate 21.

A terminal part 41 extends from one (the left) side portion of the fixation part 38 of the movable plate 22 parallelly to the movable part 37, has a gap portion 42 with two bent portions formed approximately at the middle of the extending portion, and is distorted by the elasticity of itself such that the end portion (a terminal part 41) is in a pressure contact with the external terminal 35*b* of the substrate 21.

Also, this movable plate 22 comprises a bimetal 43 that is in the shape of a shallow bowl as a thermally-actuated element that is disposed between the movable part 37 and the fixation part 38 and loosely attached to the movable plate 22.

The position of this bimetal 43 is loosely fixed to pawl parts 44 that are formed at two places, and formed by extending the terminal parts of the fixation part 38 of the movable plate 22 to both sides, and by bending these extended parts at a right angle and the root part of the movable part 37 that continues from the fixation part 38 by using two L-shaped concave parts 45 (they are convex to the direction of the bimetal 43) formed by the cutting and extruding.

Also, the movable part 37 has a tongue piece 46 that is made by cutting and that extends from the base of the movable plate 37 to the position corresponding to the center of the bimetal 43. Also, an oval concave part 47 (convex to the direction of the bimetal 43) is formed at the position adjacent to and above the movable contact 39 by extruding it from the surface (the side toward the reader in the figure).

In the above configuration, the tongue piece 46 of temperature switch 33 according to the present embodiment is in a position of pressure contact with the center part of the bimetal 43 that is convex to the side toward the reader in FIG. 7A, i.e., to the side of the tongue piece 46 at an ambient temperature, and can cause the periphery of the bimetal 43 to abut the surface (this surface conducts the heat) of the substrate 31 almost without play.

Thereby, the heat is surely conducted to the bimetal 43, and the bimetal 43 can efficiently detect the heat on the surface of the substrate 31. Accordingly, the heat capacity of the bimetal increases. Also, in this state, the circuit between the fixed contact 34 and the movable contact 39 is closed as shown in FIG. 7B. In other words, the external terminals 35*a* and 35*b* are in a conducting state with each other.

This bimetal 43 has the temperature characteristic of inverting the warping direction at a prescribed temperature as shown in FIG. 7C, and in response to the inverting operation of the bimetal 43, the movable part 37 of the moving plate 22 is pushed up such that the plate 22 separates from the substrate 21 via the oval concave part 47 by the edge of the inverting bimetal 43, thereby the circuit between the fixed contact 34 and the movable contact 39 is opened. In other words, the conductivity between the external terminals 35*a* and 35*b* is lost.

As described above, the movable plate 22 constitutes a temperature switch that electrically opens and closes the circuit between one external terminal 35*a* that is connected to the fixed contact 34 and the other external terminal 35*b* that is connected to the terminal part 41 of the fixation part 38.

As explained above, in the temperature switch 33 according to the present invention, by attaching the movable contact 39 to the movable plate 22 (movable part 37) and by forming a terminal part at a part (fixation part 38) of the movable contact 39, the terminal part 41 of the movable plate 22 is connected to the outer terminal 35*b* (35*b*-2) and the movable plate 22 is fixed to the ceramic substrate 21 only by inserting and sliding the pawl part 30 into and on the side-cut-and-engagement portion of the substrate 21.

As a result of this, only a step of fitting is required, thus devices such as a special jig or the like are not required, and accordingly the easy assemblies are realized such that the number of steps required in the assembly is greatly reduced.

Also, by providing an elastic locking part that limits the direction in which the pawl part slides after being inserted into the substrate-side-cut-engagement portion, it is possible to attain an excellent stability after attaching.

Also, the engagement portion of the movable plate is not greater than the outer dimension of the ceramic substrate, and accordingly it is easy to handle the movable plate in view of insulation.

APPLICABILITY TO INDUSTRIES

As described above, the temperature switch according to the present invention can easily be assembled without devices such as a special jig or the like, and the present invention can be applied to all the industries in which temperature switches that can perform temperature adjustment of ceramic substrates are used.

The invention claimed is:

1. A temperature switch having an insulation substrate to which a fixed contact connected to one external terminal is attached, a movable plate that is attached to the insulation substrate, has a movable contact at a position facing the fixed contact, and is connected to an other external terminal, and a thermally-actuated element which is loosely attached to the movable plate and whose warping direction is inverted at a prescribed temperature for electrically opening and closing a line between one of the external terminals and the other external terminal connected to the fixed contact and the movable contact, wherein:

the movable plate has, on both sides thereof, pawl parts each having a U-shaped cross section with an opening height that catches a side portion thickness of the insulation substrate;

the insulation substrate has, on both sides thereof, cut-out portions that are wider than widths of the pawl parts and deeper than tip lengths of the pawl parts; and the movable plate catches both side-portions of the insulation substrate and is fixed to the insulation substrate by using the pawl parts when the pawl parts are fitted into the cut-out portions and slid in a prescribed pawl-part-width direction;

wherein:

the cut-out portion has two steps in a direction from a side portion to a center of the insulation substrate;

the pawl part has a width that is smaller than a width of a second cut-out portion of the insulation substrate having the two steps, has the tip length that is smaller than a depth of the second cut-out portion, and has the opening height that catches a side-portion thickness having a first cut-out portion of the insulation substrate having the two steps; and the movable plate is positioned with the width-direction-end part at a sliding-direction-downstream side of the pawl part abutting a gap portion between the first cut-out portion and the side portion and the pawl part catches a side-portion thickness having the first cut-out portion of the insulation substrate and is fixed to the insulation substrate when the pawl part is fitted into the second cut-out portion and the movable part slides in a direction of the first cut-out portion direction.

2. The temperature switch according to claim 1, wherein:

the movable plate has an elastic locking part that is adjacent to the pawl part on a sliding-direction-upstream side, that has an L-shaped cross section, and that has a projection length smaller than that of the pawl part; and the elastic locking part reversibly warps upwardly in entirety with the L-shaped tip abutting a top surface of the insulation substrate when the pawl part is fitted into the second cut-out portion, and recovers from warping and is positioned with the L-shaped tip overlapping the second cut-out portion and with the width-direction-end part on a sliding-direction-downstream side abutting a gap portion between the first cut-out portion and the second cut-out portion.

3. The temperature switch according to claim 2, wherein:

a substrate-thickness having the first cut-out portion of the insulation substrate is formed to be one step smaller than a thickness substrate main body; and the opening height of the pawl part of the movable plate is formed to be one step narrower than a thickness of the substrate main body, and is formed to be great enough to catch a substrate thickness having the first cut-out portion.

4. The temperature switch according to claim 3, wherein:

the main body of the insulation substrate comprises two insulation substrates of an upper insulation substrate and a lower substrate; and the first cut-out portion is formed on the upper insulation substrate of the main body.

5. The temperature switch according to claim 4, wherein:

in the movable plate, when the pawl parts slide and are engaged with the first cut-out portion of the insulation substrate and an entirety is fixed to the insulation substrate, the pawl parts are set to be further in toward the same plane on both side surfaces and a bottom surface of the insulation substrate respectively.

6. The temperature switch according to claim 5, wherein:

the insulation substrate is a ceramic substrate including a heater.

7. The temperature switch according to claim 1, wherein the first cut-out portion of the insulation substrate includes a substrate-thickness that is one step smaller than a thickness of a main body of the insulation substrate; wherein the pawl part of the movable plate includes an opening height that is one step narrower than a thickness of the main body of the insulation substrate; and wherein the pawl part of the movable plate is great enough to catch a substrate thickness having the first cut-out portion.

8. The temperature switch according to claim 7, wherein the main body of the insulation substrate comprises two insulation substrates of an upper insulation substrate and a lower substrate; and wherein the first cut-out portion is formed on the upper insulation substrate of the main body.

9. The temperature switch according to claim 8, wherein in the movable plate, when the pawl parts slide and are engaged with the first cut-out portion of the insulation substrate and an entirety is fixed to the insulation substrate, the pawl parts are set to be further in toward the same plane on both side surfaces and a bottom surface of the insulation substrate respectively.

10. The temperature switch according to claim 9, wherein the insulation substrate is a ceramic substrate including a heater.

11. The temperature switch according to claim 8, wherein the insulation substrate is a ceramic substrate including a heater.

* * * * *